US011407143B2

(12) United States Patent
Scardovi et al.

(10) Patent No.: US 11,407,143 B2
(45) Date of Patent: Aug. 9, 2022

(54) PLANT AND METHOD FOR MANUFACTURING CERAMIC ARTICLES

(71) Applicant: SACMI COOPERATIVA MECCANICI IMOLA SOCIETÀ COOPERATIVA, Imola (IT)

(72) Inventors: Stefano Scardovi, Imola (IT); Gildo Bosi, Imola (IT)

(73) Assignee: SACMI COOPERATIVA MECCANICA IMOLA SOCIETA' COOPERATIVA

( * ) Notice: Subject to any disclaimer, the term of this patent is extended or adjusted under 35 U.S.C. 154(b) by 125 days.

(21) Appl. No.: 16/492,566

(22) PCT Filed: Mar. 9, 2018

(86) PCT No.: PCT/IB2018/051563
§ 371 (c)(1),
(2) Date: Sep. 9, 2019

(87) PCT Pub. No.: WO2018/163124
PCT Pub. Date: Sep. 13, 2018

(65) Prior Publication Data

US 2020/0039108 A1 Feb. 6, 2020

(30) Foreign Application Priority Data

Mar. 9, 2017 (IT) ..... 102017000026199

(51) Int. Cl.
*B28B 13/02* (2006.01)
*B28B 3/12* (2006.01)
(Continued)

(52) U.S. Cl.
CPC ..... *B28B 13/022* (2013.01); *B28B 3/12* (2013.01); *B28B 5/021* (2013.01); *B28B 17/0081* (2013.01)

(58) Field of Classification Search
CPC ..... B28B 13/022; B28B 3/12; B28B 5/021; B28B 13/0215; B28B 3/123; B28B 5/027;
(Continued)

(56) References Cited

FOREIGN PATENT DOCUMENTS

CN 101549522 A 10/2009
CN 106671255 A 5/2017
(Continued)

OTHER PUBLICATIONS

Third Party Observation received for European Patent Application No. 18715804.3, mailed on Apr. 6, 2021, 2 pages.

*Primary Examiner* — Jacob T Minskey
*Assistant Examiner* — S. Behrooz Ghorishi
(74) *Attorney, Agent, or Firm* — Workman Nydegger

(57) ABSTRACT

A plant for manufacturing ceramic articles comprising two feeding devices, each of which is designed to contain a powder material of a respective type and to feed said powder material to a conveyor assembly; the plant further comprises an operating device which is designed to enable the output of the powder material selectively in the area of the feeding devices arranged successively and transversely to the feeding direction, and a control unit which controls the operating device depending on a desired reference distribution and how far the conveyor assembly feeds the powder material.

7 Claims, 7 Drawing Sheets

(51) Int. Cl.
*B28B 5/02* (2006.01)
*B28B 17/00* (2006.01)

(58) Field of Classification Search
CPC . B28B 1/005; B28B 17/0063; B28B 17/0081; B30B 5/06; B30B 15/308
See application file for complete search history.

(56) References Cited

FOREIGN PATENT DOCUMENTS

| | | | | |
|---|---|---|---|---|
| EP | 1745906 | | 1/2007 | |
| EP | 1787779 | | 5/2007 | |
| EP | 1787779 | A2 * | 5/2007 | ..... B28B 1/005 |
| EP | 2065150 | | 6/2009 | |
| EP | 2065150 | A1 * | 6/2009 | ..... B28B 13/022 |
| WO | 2005068146 | | 7/2005 | |
| WO | WO-2005068146 | A2 * | 7/2005 | ..... B28B 3/10 |

* cited by examiner

PLANT AND METHOD FOR MANUFACTURING CERAMIC ARTICLES

PRIORITY CLAIM

This application is a 371 nationalization of PCT/IB2018/051563 filed on Mar. 9, 2018, which claims priority from Italian Patent Application No. 102017000026199 filed on Mar. 9, 2017, the disclosures of which are incorporated by reference in their entirety.

TECHNICAL FIELD

The present invention relates to a plant and a method for manufacturing ceramic articles.

BACKGROUND OF THE INVENTION

In the field of the production of ceramic articles (in particular, slabs; more specifically, tiles) it is known to use machines for compacting semi-dry powders (ceramic powders with a moisture content of approximately 5-6%). These machines comprise ceramic powder feeding devices of various types.

Often these machines are used to produce products which imitate natural stones such as marble and/or granite. These products have internal veins distributed randomly within the thickness of the products.

Alternatively or in addition, it may be appropriate to use powders of different types in order to obtain articles with particular structural and/or physical characteristics.

In some cases, mixtures of powders of different colours with a random distribution are delivered into the cavity of steel moulds and then compressed in such a way as to obtain, for example, slabs of compacted powder.

Production of slabs with random distribution of powders of various colours has also been suggested, by using continuous compaction machines comprising a conveyor assembly for conveying (in a substantially continuous manner) the powder material along a given path through a work station, in an area where a compacting device is arranged, which is suitable, by means of the use of pressure rollers, to compact the powder material so as to obtain a layer of compacted powder.

An example of a continuous ceramic powder compacting machine is described in the international patent application with publication number WO2005/068146 by the same applicant as the present application.

It is also known to create (for example by means of digital printing) graphic decoration over the layer of compacted ceramic powder in order to make the finished article more visually similar to a natural product.

However, the systems currently available for compacting ceramic powders of different types have several drawbacks. These include the following. The distribution of the powders occurs in a random way and is thus intrinsically not reproducible. Very rarely, the veins that are formed in the thickness of the articles (and therefore visible when looking at the edge of the articles) are in a coordinated position with respect to the surface decorations obtained by printing. The aesthetics of the product suffer significantly, making the dissimilarity with respect to a natural product (for example marble) much more obvious.

The object of the present invention is to provide a plant and a method for the manufacture of ceramic articles, which make it possible to overcome, at least partially, the drawbacks of the known art, while at the same time being economical and easy to manufacture.

SUMMARY

A plant and a method for the manufacture of ceramic articles according to the present invention are provided, as claimed in the independent claims which follow and, preferably, in any claims directly or indirectly dependent on the independent claims.

BRIEF DESCRIPTION OF THE FIGURES

The invention is described below with reference to the accompanying drawings which illustrate non-limiting examples of embodiments of it, wherein.

DETAILED DESCRIPTION

Figure 1:
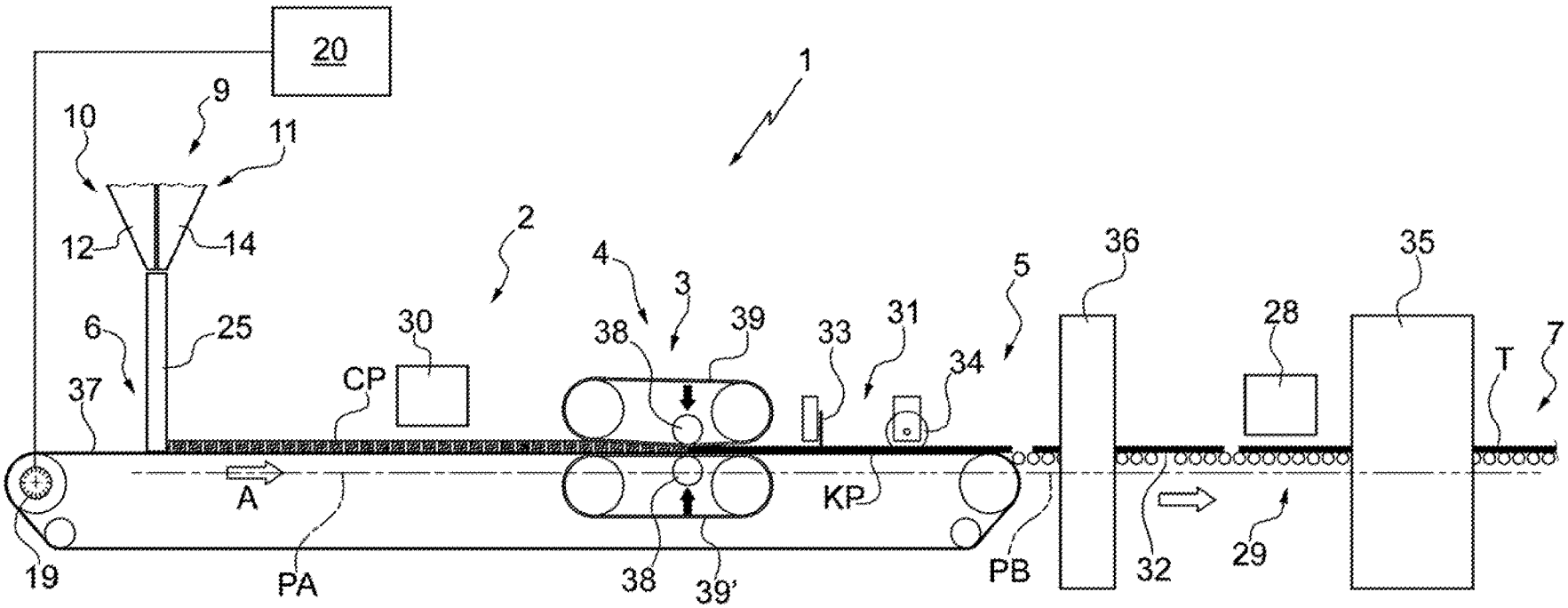
FIG. 1 is a lateral and schematic view of a plant in accordance with the present invention.

In accordance with a first aspect of the present invention, in FIG. 1, the numeral 1 denotes in its entirety a plant for the manufacture of ceramic articles T. The plant 1 is provided with a compacting machine 2 for compacting powder material CP, comprising ceramic powder (in particular, the powder material CP is ceramic powder).

In particular, the ceramic articles T produced are slabs (more specifically, tiles).

The machine 2 comprises a compacting device 3, which is arranged in the area of a work station 4 and is designed to compact the powder material CP so as to obtain a layer of compacted powder KP; and a conveyor assembly 5 for transporting the powder material CP (in a substantially continuous way) along a portion PA of a given path from an input station 6 to the work station 4 in a feeding direction A and the layer of compacted powder KP from the work station 4 along a portion PB of the given path to an output station 7 (in particular, along the direction A). In particular, the given path consists of the portions PA and PB.

Figure 4:
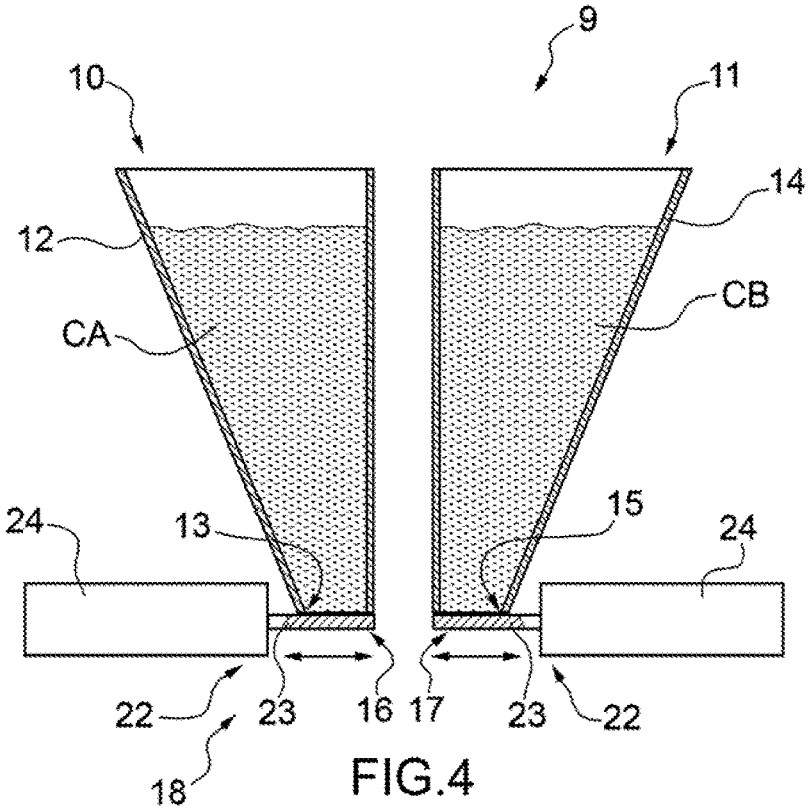
FIG. 4 is a partially sectioned lateral view of a detail of the plant of FIG. 1.
Figure 5:
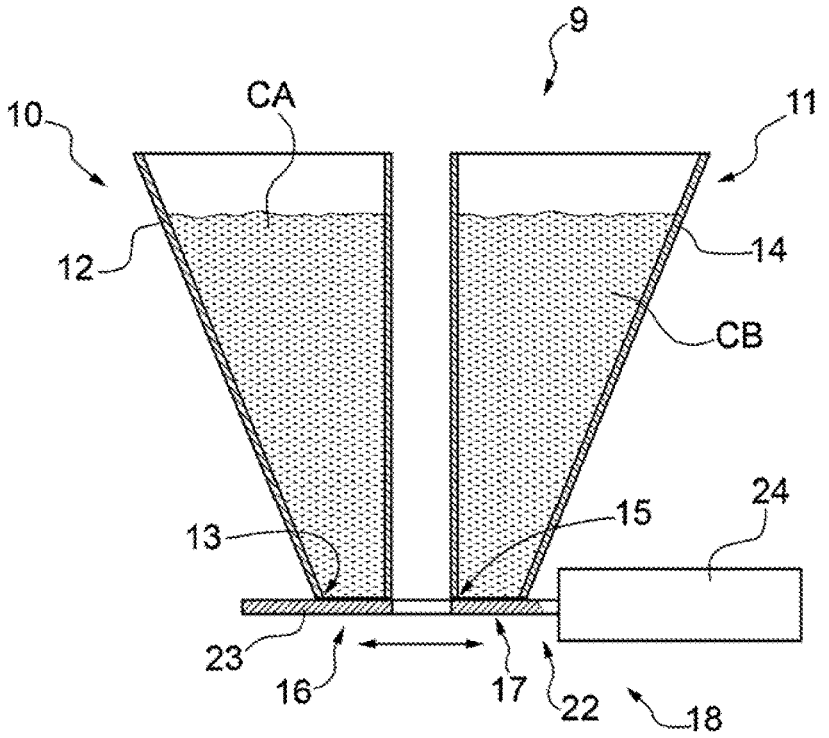
FIG. 5 is a partially sectioned lateral view of an alternative embodiment of the detail of FIG. 4.

The machine 2 is also provided with a feeding assembly 9, which comprises a feeding device 10 and a feeding device 11 arranged above the conveyor assembly 5. The feeding device 10 is designed to contain a (ceramic) powder material CA of a first type and comprises a respective containment chamber (as shown in FIG. 4) having a respective output mouth 13, whose longitudinal extension is transverse (in particular, perpendicular) to the feeding direction. The second feeding device 11 is designed to contain a powder material CB of a second type and comprises a respective containment chamber 14 having a respective output mouth 15, whose longitudinal extension is transverse (in particular, perpendicular) to the feeding direction A. In particular, the longitudinal extensions of the output mouths 13 and 15 are substantially parallel to each other.

More specifically, the containment chamber 12 is designed to contain the powder material CA and the containment chamber 14 is designed to contain the powder material CB.

According to some non-limiting embodiments, the powder materials CA and CB (are ceramic and) are different in colour from each other. It is thus possible to create chromatic effects in the thickness of the ceramic articles T. These chromatic effects are for example visible in the edges of the ceramic articles. Alternatively or in addition, the powder materials CA and CB are designed to deliver different physical characteristics to the ceramic articles T.

In particular, the powder material CP consists of one or both of the powder materials CA and CB. More precisely, the powder material CP comprises (and consists of) the powder materials CA and CB.

The output mouth 13 has respective passage areas 16 (shown, in particular, in FIG. 7) arranged in succession along the longitudinal extension of the output mouth 13. The output mouth 15 has respective passage areas 17 arranged in succession along the longitudinal extension of the output mouth 15. The feeding assembly 9 further comprises an operating device 18 (shown, in particular, in FIG. 2), which is designed to enable the output of the powder material selectively through one or more of the passage areas 16 and 17. In particular, each first passage area 16 is arranged beside (more specifically, in front of; in particular, associated with) a respective passage area 17.

The machine 2 (FIG. 1) further comprises a detection device 19 (for example, an encoder) for detecting how far the conveyor device 5 transports the powder material CP along the given path (in the feeding direction A), in particular, along the portion PA, and a control unit 20, which is designed to store a reference distribution 21 (FIG. 3) of the powder material CA and CB of the first and of the second type (as desired to be obtained) in the powder material CP transported by the conveyor assembly 5 and to control the operating device 18 depending on the data detected by the detection device 19 and on the reference distribution 21. More in particular, the control unit 20 is designed to control the operating device 18, depending on the data detected by the detection device 19 so as to reproduce (on the conveyor assembly 5) the reference distribution 21.

Figure 2:
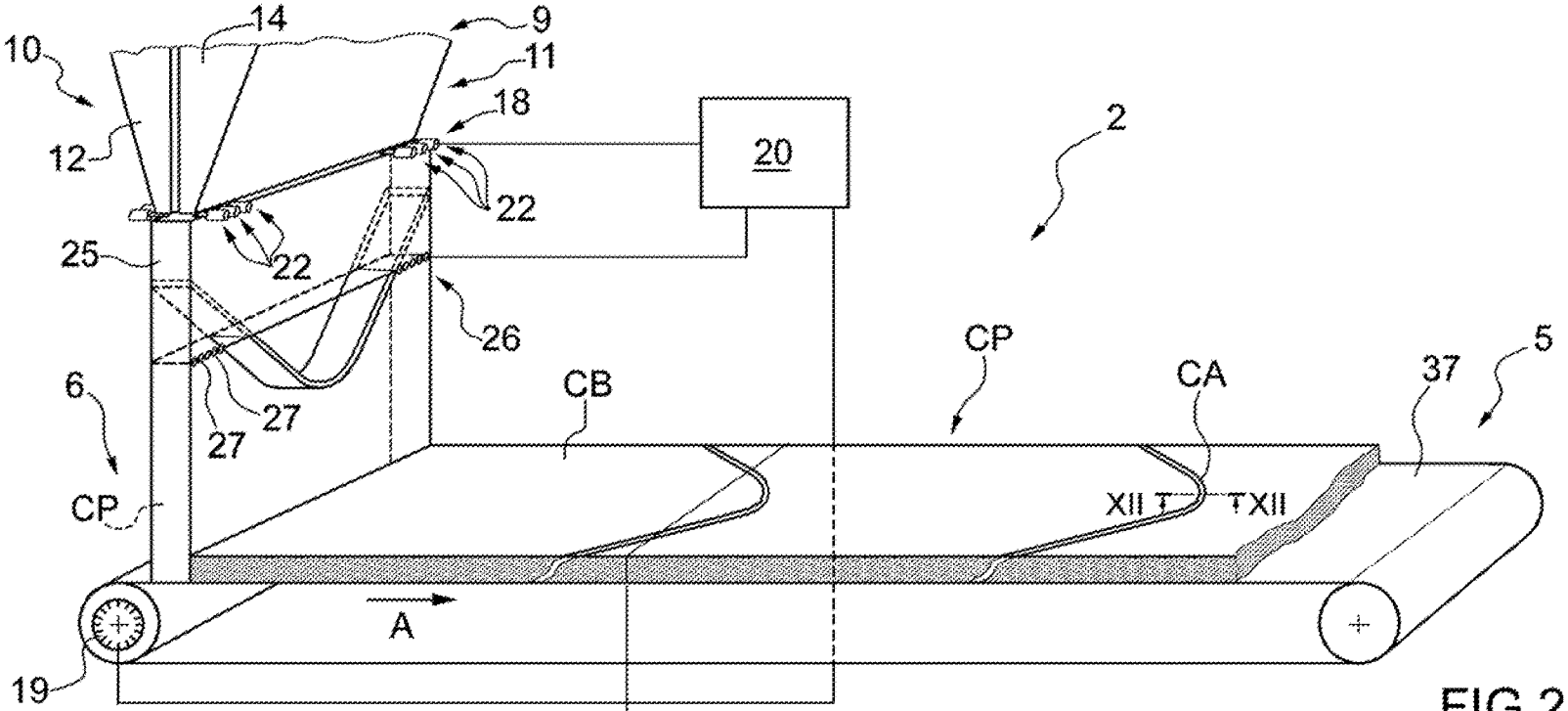
FIG. 2 is a schematic perspective view of part of the plant of FIG. 1.
Figure 7:
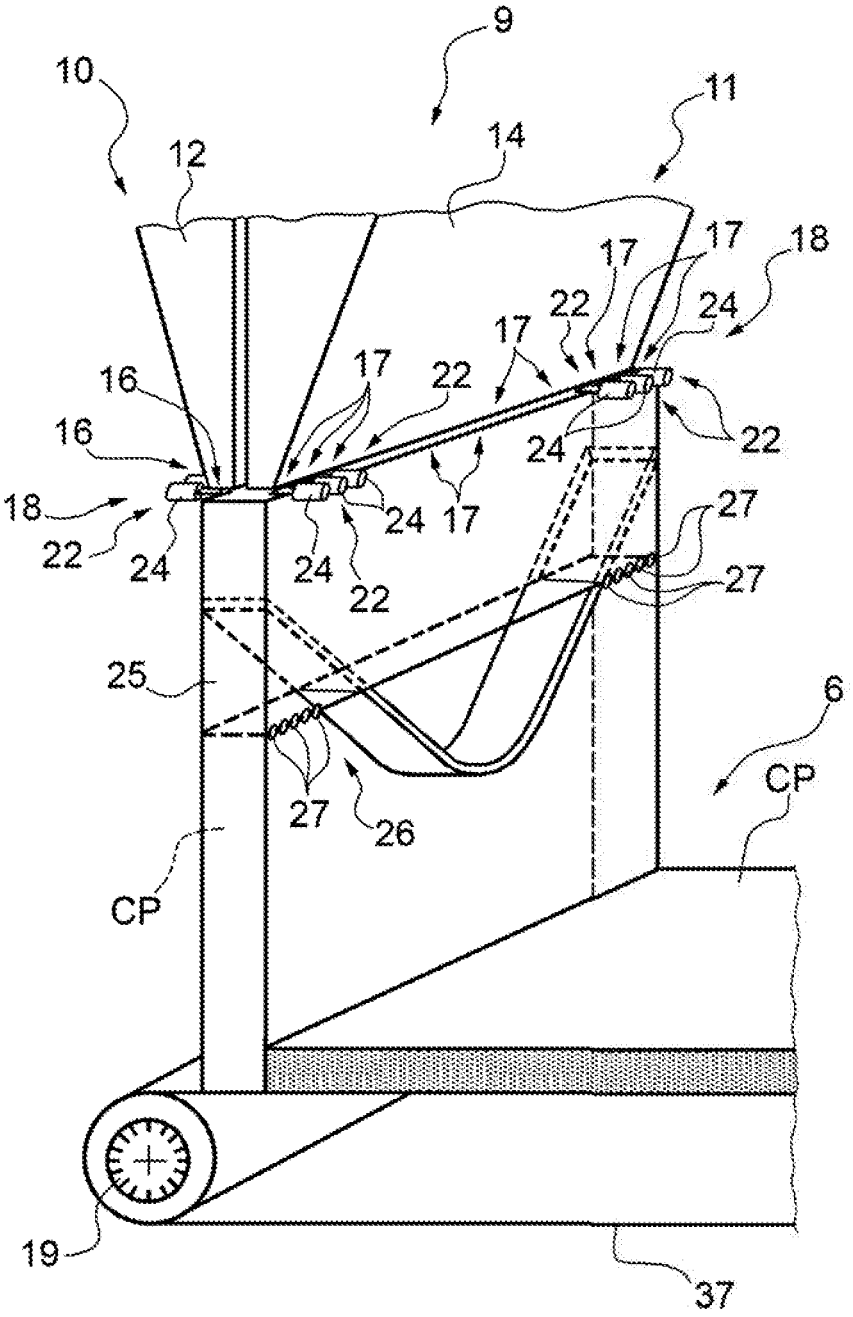
FIG. 7 shows, in enlarged scale, a detail of FIG. 2.

According to some non-limiting embodiments (shown, in particular, in FIGS. 2, 4, 5 and 7), the operating device 18 comprises a plurality of operating units 22 (only six of which are shown in FIGS. 2 and 7), each of which is arranged in the area of a respective passage area 16 or (and/or) 17 and is designed to regulate the passage of the powder material through the respective passage area 16 or (and/or) 17. In particular, the operating units 22 are arranged successively (in a transverse direction—in particular, perpendicular—to the feeding direction A) along the longitudinal extension of the output mouth 13 or (and/or) 15.

Advantageously but not necessarily, each operating unit comprises at least one respective shutter 23 and one respective actuator 24 (for example, an electrical actuator) designed to move the shutter 23 between a closed position (shown in FIGS. 4 and 5), in which the shutter 23 prevents the passage of powder material through the respective first and/or second passage area 16 and/or 17, and an open position (not shown), in which the shutter 23 at least partially does not prevent the passage of powder material through the respective first and/or second passage area 16, 17.

According to some non-limiting embodiments (such as those shown in FIGS. 2, 4 and 7), the operating device 18 comprises two assemblies (lines) of operating units, each assembly (line) of which is associated with a containment chamber 12 and 14. Each operating unit 22 is designed to regulate the passage of powder material CA through either (not both) a respective passage area 16 or 17. It is thus possible to obtain (at any time) a specific mixture of the powder materials CA and CB.

According to some non-limiting embodiments (such as those shown in FIG. 5), the operating device 18 comprises (only) one assembly (line) of operating units 22. Each operating unit 22 is designed to regulate the passage of powder material CA through (both) a respective area 16 and a respective area 17. It is thus possible to simplify the operating device 18 and reduce its costs.

According to some non-limiting embodiments (FIG. 8), the feeding assembly 9 comprises more than two feeding devices 10 and 11. Each of these additional feeding devices is structured similarly to the feeding devices 10 and 11 and is designed to contain powder material of additional types.

Figure 8:
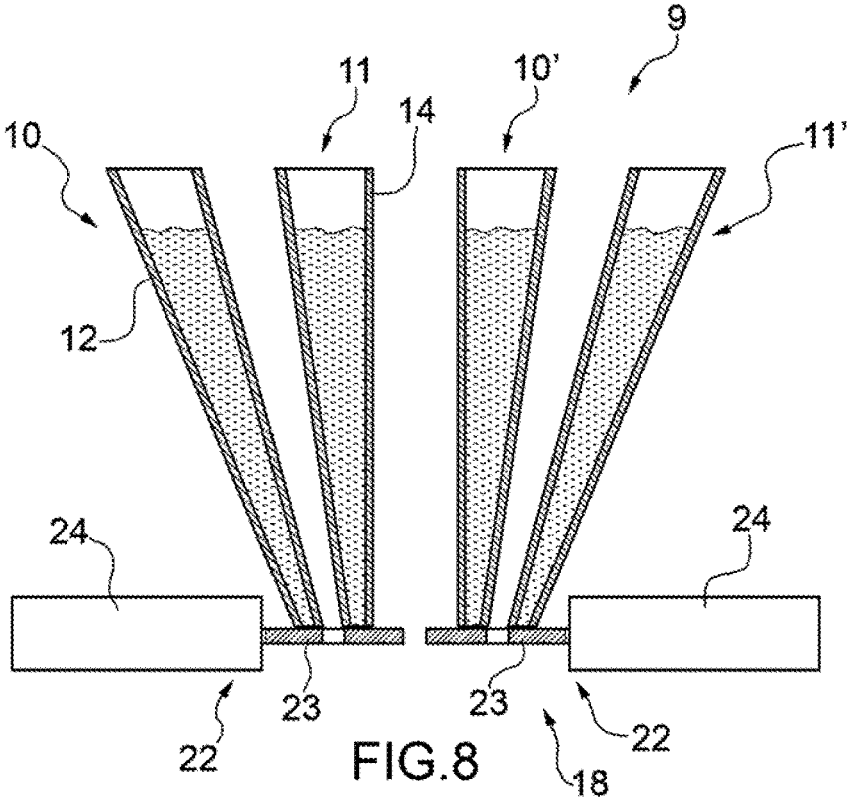
FIG. 8 is a partially sectioned lateral view of an alternative embodiment of the detail of FIG. 4.

For example, the operating assembly 9 of FIG. 8 also comprises the feeding devices 10' and 11'. Advantageously but not necessarily, in this case, actuating units 22 are provided, each of which is designed to regulate the passage of the powder material through the passage areas of two of the four feeding devices 10, 11, 10' and 11'.

Figure 3:
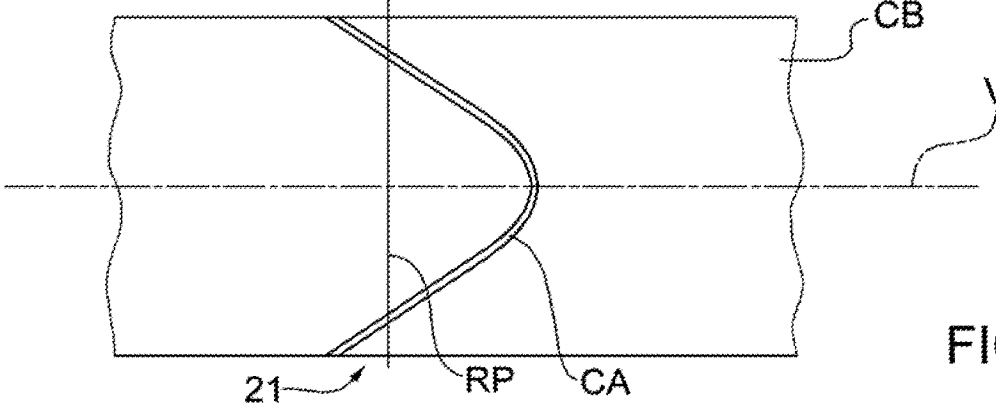
FIG. 3 is a virtual diagram of part of the control procedure for the plant of FIG. 1.

Advantageously but not necessarily, the control unit 20 comprises a memory, wherein the reference distribution 21 is stored (FIG. 3). The control unit 20 is designed to feed the reference distribution 21 along a virtual path VP through a virtual reference front RP depending on (according to) the data detected by the detection device 19. More in particular, the control unit 20 is designed to feed the reference distribution 21 along the virtual path VP along a virtual reference front RP of the length detected by the detection device 19.

The virtual reference front RP has a plurality of positions, each of which corresponds to a passage area 16 and to a passage area 17, which are adjacent to one another. The control unit 20 is designed to enable the output of the powder material CA and/or CB at a specific time through the passage areas 16 and/or 17 depending on the type of powder material CA and/or CB indicated at the specific time, in the reference distribution 21, and in the positions of the virtual reference front RP corresponding to said passage areas 16 and/or 17.

In other words, the control unit 20 is designed to enable the output of the powder material CA and/or CB at a specific time through each passage area 16 and/or 17 depending on the type of powder material which is provided for each position given by the intersection between the virtual reference front RP and the reference distribution 21 at that specific time.

More specifically, in use, if at a specific time the virtual reference front RP intersects at a given position with an area of the reference distribution 21 wherein the powder material CA of the first type is provided, the passage area 16, which corresponds to a given position, will be (kept) open, whereas the passage area 17, which corresponds to the given position, will be (kept) closed.

Analogously, if at a specific time the virtual reference front RP intersects at a given position with an area of the reference distribution 21 wherein the powder material CB of the second type is provided, the passage area 16, which corresponds to a given position, will be (kept) closed, whereas the passage area 17 of the output mouth, which corresponds to the given position, will be (kept) open.

Furthermore, if at a specific time the virtual reference front RP intersects at a given position with an area of the reference distribution of 21 wherein both powder materials CB and CA are provided, both passage areas 16 and 17, which correspond to the given position, will be (kept) open.

Advantageously but not necessarily, the feeding assembly 9 comprises a containment chamber 25, which is designed to contain the powder material CP received from the feeding devices 10 and 11 and to transfer the powder material CP to the conveyor assembly 5 in the area of the input station 6; the containment chamber 25 is arranged between the feeding devices 10 and 11 on one side and the conveyor assembly 5 on the other side. In particular, the containment chamber 25 is arranged under the feeding devices 10 and 11 and above the conveyor assembly 5.

It is, thus, possible to compensate for possible temporary interruptions in the feed of powder material.

Advantageously but not necessarily, the compacting machine 2 comprises a detection device 26, which is designed to detect the level of powder material inside the containment chamber 25. The control unit 20 is designed to operate the operating device 18 depending on the level of powder material CP detected inside the containment chamber 25. In particular, the control unit 20 is designed to operate the operating device 18 so as to maintain the level of powder material CP inside the containment chamber 25 below a maximum level (and above a minimum level). More precisely, the control unit 20 is designed to operate the operating device 18 so as to activate the feeding of powder material to the containment chamber 25 when, in use, the amount of powder material is below a first reference level and by stopping the feed of powder material to the containment chamber 25 when, in use, the amount of powder material is above a second reference level. In some cases, the first reference level and the second reference level are the same.

According to some non-limiting embodiments (as shown in FIGS. 2 and 7), the detection device 26 is provided with a plurality of sensors 27, each of which is designed to detect the level of powder material CP inside the containment chamber 25 (substantially vertically) under a respective passage area 16 (and/or 17). The control unit 20 is designed to activate each operating unit 22 depending on the data detected by the sensor 27 arranged under the respective passage area 16 (and/or 17). In particular, the control unit 20 is designed to enable the passage of the powder material through a passage area 16 (and/or through to the adjacent passage area 17), when the corresponding sensor 27 (i.e. the sensor 27 located vertically below the area 16 and/or 17) does not detect the presence of powder material in the containment chamber 25 (at its position), and to prevent the passage of the powder material through a passage area 16 (and/or through to the adjacent passage area 17), when the corresponding sensor 27 (i.e. the sensor 27 located vertically below the area 16 and/or 17) detects the presence of powder material in the containment chamber 25 (at its position).

Each sensor 27 comprises (consists of), for example, an optical, or resistive, or capacitive, etc. detector. According to some specific non-limiting embodiments, the sensor device 26 comprises (and consists of) a row of sensors (of which only ten are shown in FIGS. 2 and 7) spaced apart (for example) by 10 mm. In these cases, the operating device 18 comprises actuating units 22 spaced apart (for example) by 10 mm.

According to some non-limiting embodiments, not shown, the machine 2 does not have the sensor device 26 (and thus does not have the sensors 27). In these cases, in use, the level of powder material inside the containment chamber 25 is maintained substantially flush with the output mouths 13 and/or 15. In other words, in use, for each pair of passage areas 16 and 17 at least shutters 23 is (always) kept (at least partially) in the open position, in particular so as to allow the passage of the powder material through at least output mouths 13 and 15.

More in particular, also in these cases, the control unit 20 is designed to enable the output of the powder material CA and/or CB at a specific time through the passage areas 16 and/or 17 depending on the type of powder material CA and/or CB indicated at the specific time, in the reference distribution 21, and in the positions of the virtual reference front RP corresponding to said passage areas 16 and/or 17.

According to some non-limiting embodiments, the plant comprises a printing device 28 (FIG. 1), which is designed to create a graphic decoration over the layer of compacted ceramic powder KP transported by the conveyor assembly 5 and is arranged in the area of a printing station (arranged upstream of the output station 7) along the given path (in particular, along the portion PB) downstream of the work station 4. The control unit 20 is designed to control the printing device 28 so as to create a graphic decoration coordinated with said reference distribution 21, in particular so that a graphic decoration of a specific colour is (selectively) reproduced in the powder material CA.

Advantageously but not necessarily, the plant 1 comprises a further application assembly 30 to at least partially cover the layer of compacted powder KP with a layer of another powder material. In particular, the application assembly 30 is arranged along the given path (more specifically along the portion PA) upstream of the work station 4 (and upstream of the printing station 29).

In particular, the machine 1 further comprises a cutting assembly 31 for cutting the layer of compacted powder KP transversely so as to obtain slabs 32, each of which has a portion of the layer of compacted powder KP. More in particular, the cutting assembly 31 is arranged along the portion PB of the given path (between the work station 4 and the printing station 29). The slabs 32 comprise (consist of) compacted ceramic powder KP.

Advantageously but not necessarily, the cutting assembly 31 comprises at least one cutting blade 33, which is designed to come in contact with the layer of compacted ceramic powder KP to cut it transversely.

According to some non-limiting embodiments, the cutting assembly 31 also comprises at least two further blades 34, which are arranged on opposite sides of the portion PB and are designed to cut the layer of compacted ceramic powder KP and define the lateral edges of the slabs 32 (and substantially parallel to the direction A)—possibly by subdividing the slabs into two or more longitudinal portions. In some specific cases, the cutting assembly 31 is similar to that described in the patent application with publication number EP1415780.

In particular, the plant 1 comprises at least one baking oven 35 for sintering the layer of compacted powder KP of the slabs 32 in order to obtain the ceramic articles T. More specifically, the baking oven 35 is arranged along the given path (more specifically along the portion PB) downstream of the printing station 29 (and upstream of the output station 7).

According to some non-limiting embodiments, the plant 1 further comprises a dryer 36 arranged along the portion PB downstream from the work station 4 and upstream of the printing station 29.

According to some non-limiting embodiments, the conveyor group 5 comprises a conveyor belt 37 extending (and and designed to move) from the input station 6 and through the work station 4, along the (more specifically, part of the) said given path.

In some cases, the feeding assembly 9 is designed to carry a layer of (uncompacted) powder material CP to (onto) the conveyor belt 37 (at the input station 6); the compacting device 3 is designed to exert pressure, transverse (in particular, normal) to the surface of the conveyor belt 37, on the layer of ceramic powder CP.

According to some non-limiting embodiments, a succession of conveyor rollers is provided downstream of the conveyor 37.

According to some embodiments, in particular, the compacting device 3 comprises at least two compression rollers 38 arranged on opposite sides of the transfer belt (one above it and one below it) to exert pressure on the powder material CP in such a way as to compact the powder material CP (and obtain the layer of compacted powder KP).

Although in FIG. 1 only two rollers 38 are shown, in accordance with some variants, it is also possible to provide a plurality of rollers 38 arranged above and below the conveyor belt 37, as described for example in patent EP1641607B1, from which further details of the compacting device 3 can be deduced.

Advantageously (as in the embodiment shown in FIG. 1) but not necessarily, the compacting device 3 comprises a pressure belt 39, which converges towards the conveyor belt 37 in the feeding direction A. In this way, a (top to bottom) pressure, gradually increasing in the direction A, is exerted on the powder material CP in such a way as to compact it.

According to specific embodiments (such as that shown in FIG. 1), the compacting device also comprises an opposing belt 39' arranged on the opposite side of the conveyor belt 37 with respect to the pressure belt 13 to work together with the conveyor belt 37 to provide an appropriate response to the force exerted downwards by the pressure belt 39. In particular, the pressure belt 39 and the opposing belt 39' are (mainly) made of metal (steel) so as not to be able to be substantially deformed while pressure is exerted on the ceramic powder.

According to some embodiments not shown, the opposing belt 39' and the conveyor belt 37 are the same. In these cases, the belt 37 is (mainly) made of metal (steel) and the opposing belt 39' is absent.

Figure 6:
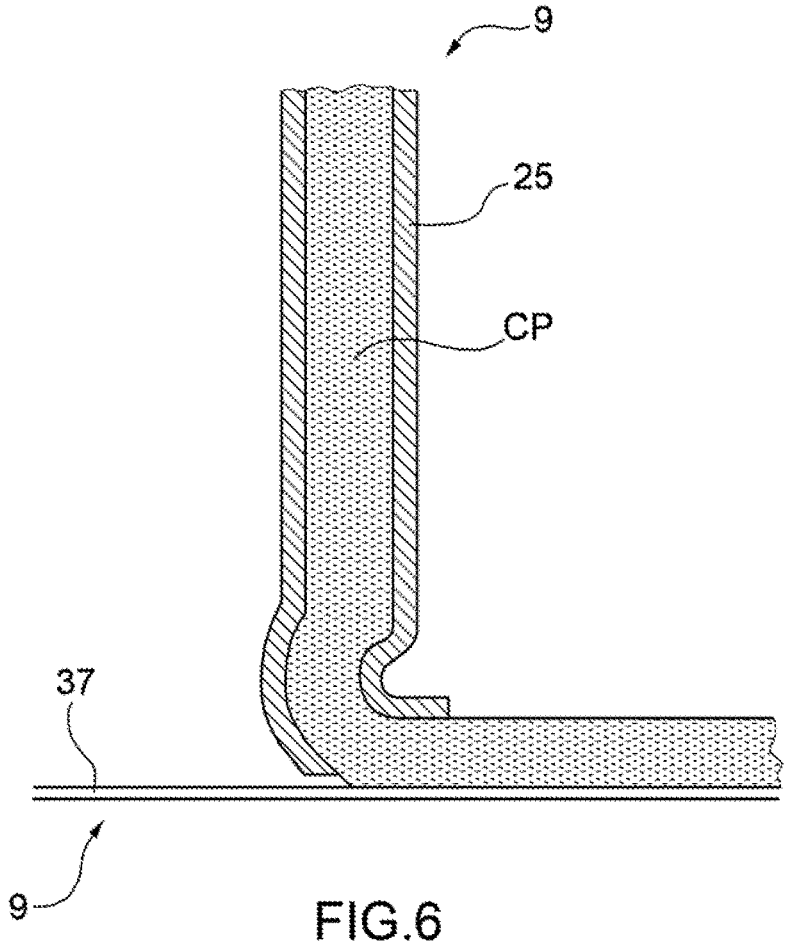
FIG. 6 is a lateral sectioned view of a further detail of the plant of FIG. 1.

In FIG. 6 an advantageous (but non-limiting) embodiment of the lower end of the containment chamber 25 is shown.

Figure 9:
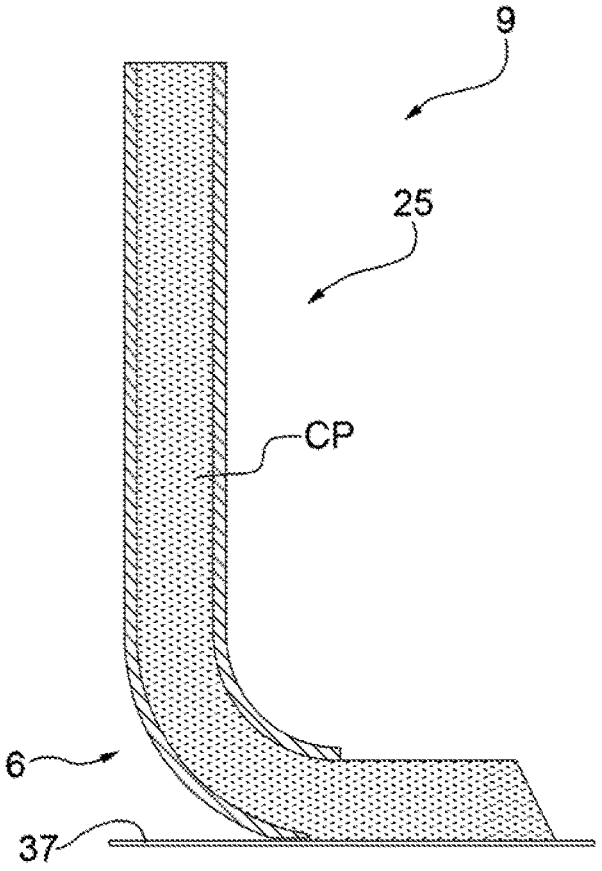
FIGS. 9 to 11 are lateral sectioned views of an alternative embodiment of the detail of FIG. 6.

In accordance with some variants, the lower end of the containment chamber 25 has the shape shown in FIG. 9. More precisely, the containment chamber 25 comprises two walls (transverse, in particular perpendicular, to the direction A) facing each other (and preferably substantially parallel). According to some embodiments, these walls have a curved region in the area of the conveyor belt 37. In particular, the containment chamber 25 has an end opening (at least partially) oriented in the same direction as the feeding direction A.

Figure 10:
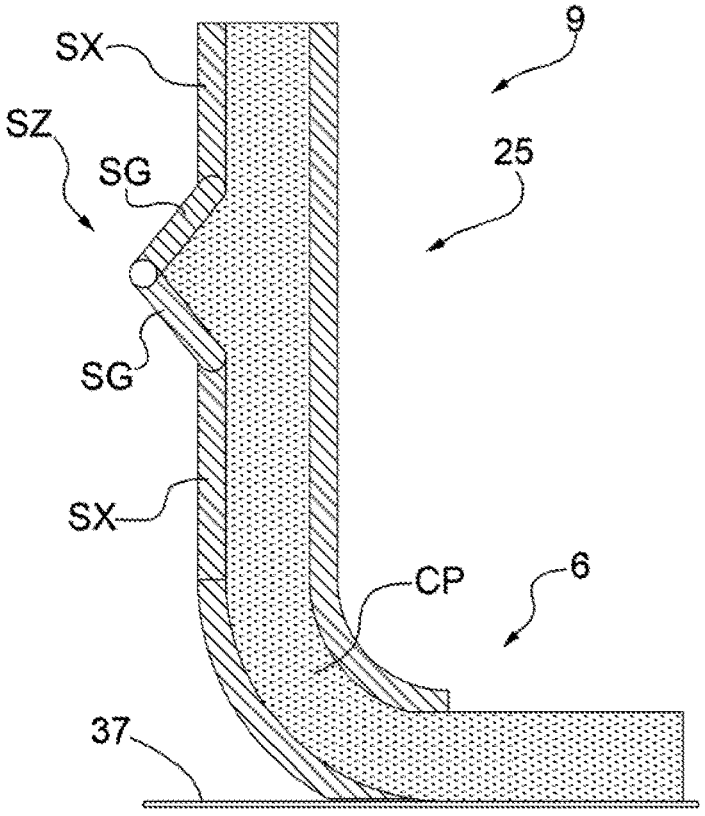
Figure 11:
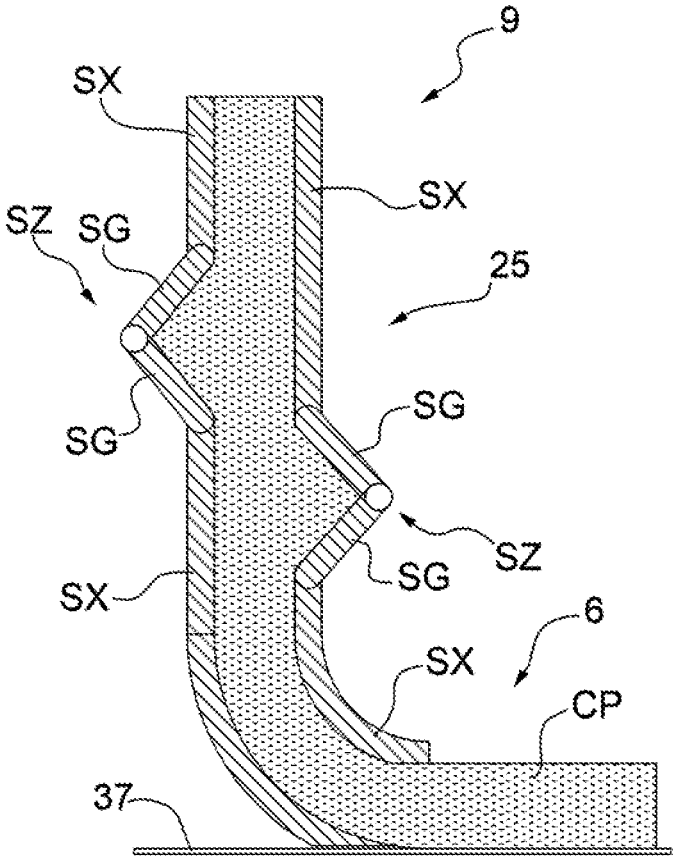

Advantageously but not necessarily (FIGS. 10 and 11), at least walls of the containment chamber 25 has (at least) one area SZ with a non-linear (non-straight) inner surface, in particular shaped with an (inward facing) internal concavity of the containment chamber 25.

The area SZ makes it possible to reproduce the reference distribution 21. In other words, the area SZ makes it possible to modify the (shape of the) distribution of the powder material CA and CB of the first and of the second types.

In this respect, it should be noted that it is experimentally observed that, in use, while the powder material CP is conveyed along the portion PA (and the containment chamber 25), the shape of the reproduction of the reference distribution 21 in the thickness of the powder material CP is often deformed (in particular, due to friction with the walls).

Figure 12:
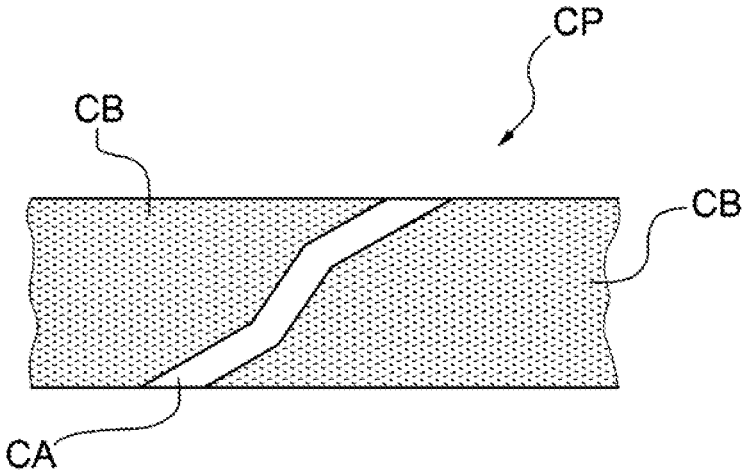
FIG. 12 is a section along the line XII-XII of FIG. 2.

As an example, FIG. 12 illustrates a section of a layer of powder material CP fed by the belt 37. As may be noted, the distribution of the powder material CA in the thickness of the powder material CP is deformed (i.e., not linear as might have been expected).

The area SZ makes it possible to compensate (at least partially) for this deformation.

According to some non-limiting embodiments not shown, the area SZ comprises (consists of) a fixed profile.

Advantageously but not necessarily, the (each) area SZ (more precisely, its inner surface) has a modifiable shape. In this way, it is possible to vary the shape of the reproduction of the reference distribution 21 (in particular, the distribution of the powder material CA) in the thickness of the powder material CP.

According to some specific non-limiting embodiments, the area SZ comprises (at least) two segments SG (of walls) mutually connected in a rotatable way (in particular, hinged to each other), and each connected in a rotatable (in particular, hinged) way to a respective portion SX of the wall of the containment chamber 25. In particular, the area SZ is arranged between two portions SX. More specifically, each segment SG extends from portions SX to the other segment SG.

According to some non-limiting embodiments, at least portions SX is movable with respect to the other portion SX. In this way (moving apart and/or moving together the portions SX) it is possible to modify the shape of the area SZ. More precisely, the closer the portions SX are together, the deeper the concavity of the area SZ; vice versa, the further the portions SX are apart, the shallower the concavity of the area SZ (in particular when the portions SX are at the maximum distance apart, the area SZ is substantially linear-straight).

In particular, at least portions SX (more specifically, the portion SX which is arranged the highest) is movable longitudinally (more specifically, vertically).

Advantageously but not necessarily, the feeding assembly 9 comprises a handling unit (known per se and not shown—for example comprising a stepping motor) for moving at least portions SX with respect to the other portion SX (and thus modifying the shape of the area SZ). In particular, said handling unit is controlled by the control unit 20.

According to some non-limiting embodiments (see for example FIG. 10), only the wall (which is transversal, in particular, to direction A) arranged upstream (relative to the direction A) of the containment chamber 25 is provided with an area SZ (in other words, the part arranged downstream—in the direction A—of the containment chamber does not have an area SZ).

Alternatively (FIG. 11), both walls (transverse, particularly perpendicular, to the direction A) are each provided with (at least) one respective area SZ.

Advantageously but not necessarily, the (each) area SZ extends only along part of the longitudinal extension (that is transverse to the direction A) of the respective wall of the containment chamber 25.

In some cases, the (each) area SZ extends along the entire longitudinal extension (that is transverse to the direction A) of the respective wall of the containment chamber 25.

According to some non-limiting embodiments, the containment chamber 25 (which extends vertically beneath the feeding devices 10 and 11) has a width of approximately 15-40 mm and a height of approximately 100-150 mm. Typically, the detection device 26 (and therefore the sensors 27) are arranged at approximately 50-80 mm from the lower end of the containment chamber 25. In accordance with possible embodiments, the output mouth located at the lower end of the containment chamber 25 has a height (depending on requirements) of approximately 5-50 mm; in this way, the layer of powder material CP conveyed by the conveyor assembly 5 has a similar thickness of approximately 5-50 mm.

In use, the powder material is supplied by the feeding device 10 and/or 11 on the basis of what is provided by the intersection between the virtual reference front RP and the reference distribution 21 by operating the specific operating unit 22 to make the powder material flow from specific passage areas 16 and/or 17 when the specific respective sensors 27 indicate a level of powder material in the containment chamber 25 (in the area of the specific sensors 27) which is lower than a reference threshold level.

In accordance with a second aspect of the present invention, a method for the manufacture of ceramic articles T is provided. The method comprises a compacting step, during which a powder material CP, comprising ceramic powder is compacted at a work station 4 so as to obtain a layer of compacted powder KP; a conveying step, during which the powder material CP is transported (in a substantially continuous manner) by a conveyor assembly 5 along a portion PA of a given path in a feeding direction A from an input station 6 to the work station 4 and the layer of compacted powder KP is transported by the conveyor assembly 5 along a second portion PB of the given path from the work station 4 to an output station 7; a feeding step, during which the powder material CP is fed onto an area of the conveyor assembly 5 in the area of the input station 6 by means of a feeding assembly 9. In particular, the conveying step and the feeding step are (at least partially) simultaneous.

The feeding assembly 9 comprises a feeding device 10, which feeds, during the feeding step, a powder material CA of a first type, and a feeding device 11, which feeds, during the feeding step, a powder material CB of a second type.

During the conveying step, a detection device detects how far the conveyor assembly 5 transports the powder material CP along the given path (in particular, along the portion PA) (in the feeding direction A).

During the feeding step, a control unit controls the feeding assembly 18 so as to change the distribution of the powder material (CA, CB) in a transverse direction to the feeding direction A depending on data detected by the detection device 19 and on a reference distribution 21 of the powder material CA and CB to be obtained of the powder material CP transported by the conveyor assembly 5.

In other words, the area of the conveyor assembly 5 (in particular, the belt 37) onto which the powder material CP is fed is defined by a succession of portions arranged in a direction transverse to the feeding direction A. The control unit 20 controls the operating device 18 in such a way that the type of powder material which is fed to the portions varies in such a way as to reproduce the reference distribution 21 as a function of what is detected by the detection device 19.

In particular, the powder material CA is of a different colour than the powder material CB.

Advantageously but not necessarily, the method is implemented by the plant 1 of the first aspect of the present invention.

According to some non-limiting embodiments, the feeding device 10 comprises a respective containment chamber 12 containing the (ceramic) powder material CA and having a respective first output mouth 13, the longitudinal extension of which is transverse to the feeding direction A. The feeding device 11 comprises a respective containment chamber 14 containing the (ceramic) powder material CB and has a respective output mouth 15, whose longitudinal extension is transverse (in particular, perpendicular) to the feeding direction A.

The output mouth 13 has respective passage areas 16 arranged in succession along the longitudinal extension of the output mouth 13. The output mouth 15 has respective passage areas 17 arranged in succession along the longitudinal extension of the output mouth 15.

According to some non-limiting embodiments, the feeding assembly 9 further comprises an operating device 18, which is designed to enable the output of the powder material selectively through one or more of the passage areas 16 and/or 17. During the feeding step, the control unit 20 operates the feeding device 10 (more precisely, the operating device 18) so that the powder material CA selectively passes through one or more of the passage areas 16 and operates the feeding device 11 (more precisely, the operating device 18) so that the powder material CB selectively passes through one or more of the passage areas 17.

Advantageously but not necessarily, the operating device 18 comprises a plurality of operating units 22, each of which is arranged in the area of a respective passage area 16 and/or 17 and is designed to regulate the passage of the powder material (CA) through the respective passage area 16 and/or 17). The control unit 20 controls each drive unit 22 independently with respect to the other drive units 22 (as a function of what is detected by the detection device 19 and of the reference distribution 21).

In particular, the control unit 20 (virtually) feeds the reference distribution 21 along a virtual path VP through a virtual reference front RP depending on (according to) the data detected by the detection device 19. The virtual reference front RP has a plurality of positions, each of which corresponds to a passage area 16 and to a passage area 17, which are adjacent to one another; the control unit 20 operates the feeding assembly 9 (in particular, the operating devices 10 and 11; more in particular, the operating device 18; even more in particular, the operating unit 22) so as to enable the output of the powder material at a specific time through the passage areas 16 and/or 17 depending on the type of powder material indicated at the specific time, in the reference distribution 21, and in the positions of the virtual reference front RP corresponding with said passage areas 16 and/or 17.

According to some non-limiting embodiments, the feeding assembly comprises a containment chamber 25, which contains the powder material received from the feeding devices 10, 11 and transfers the powder material CP to the conveyor assembly 5 in the area of the input station 6.

Advantageously but not necessarily, the detection device 26 detects the level of powder material inside the containment chamber 25. The control unit 20 operates the operating device 18 depending on the level of powder material CP detected inside the containment chamber 25. In particular, the control unit 20 enables the introduction of the powder material into the containment chamber 25 when the detection device 26 detects a level of powder material CP below a reference level (more specifically, the level at which the sensors 27 are arranged).

According to some non-limiting embodiments, the detection device 26 is provided with a plurality of sensors 27 each of which detects the level of powder material CP inside the containment chamber 25 under a respective passage area 16 (and/or 17). The control unit 20 activates each operating unit 22 depending on the data detected by the sensor 27 arranged under the respective passage area 16 (and/or 17).

Advantageously but not necessarily, the method comprises a printing step, which occurs after the compacting step and during which a graphic decoration is created over the layer of compacted ceramic powder KP conveyed by the conveyor assembly 5 in the area of a printing station 29 along the given path (in particular along the portion PB) downstream of the work station 4. The control unit 20 controls a printing device 28 so as to create a graphic decoration coordinated with said reference distribution 21, in particular so that a graphic decoration of a specific colour is reproduced in the powder material CA.

The plant and method according to the present invention make it possible to achieve several benefits with respect to the state of the art. These include: reduced costs and complexity; the possibility of obtaining a reproducible and accurate distribution of the powders; a reproducible creation of veins of different materials (and therefore, for example, of different colours—even more than two) in the thickness of the articles; and the creation of veining formed in the thickness of the articles (and therefore visible when looking at the edge of the articles) in a coordinated position with respect to the surface decorations obtained by printing.

Unless expressly indicated to the contrary, the contents of the references (articles, books, patent applications etc.) cited in this text are herein repeated in full. In particular, the above-mentioned references are herein incorporated by reference.

The invention claimed is:

1. A method for manufacturing ceramic articles, the method comprising:

a compacting step, during which a powder material comprising ceramic powder is compacted in the area of a work station so as to obtain a layer of compacted powder;

a conveying step, during which the powder material is transported in a substantially continuous manner by a conveyor assembly along a first portion of a given path in a feeding direction from an input station to the work station and the layer of compacted powder is transported by the conveyor assembly along a second portion of the given path from the work station to an output station; and a feeding step, during which the powder material is fed onto a part of the conveyor assembly in the area of the input station by means of a feeding assembly, wherein the conveying step and the feeding step are at least partially simultaneous;

wherein the feeding assembly comprises a first feeding device, which feeds, during the feeding step, a powder material of a first type, and a second feeding device, which feeds, during the feeding step, a powder material of a second type;

wherein during the conveying step, a detection device detects how much the conveyor assembly transports the powder material along the given path in the feeding direction;

wherein during the feeding step, a control unit controls the feeding assembly so as to change the distribution of the powder material of the first and of the second type in a transverse direction to the feeding direction depending on data detected by the detection device and on a reference distribution of the powder material of the first and of the second type to be obtained in the powder material transported by the conveyor assembly;

wherein the first feeding device comprises a respective first containment chamber containing the powder material of the first type and having a respective first output mouth, whose longitudinal extension is transverse to the feeding direction;

wherein the second feeding device comprises a respective second containment chamber containing the powder material of the second type and having a respective second output mouth, whose longitudinal extension is transverse to the feeding direction;

wherein the first output mouth has respective first passage areas arranged in succession along the longitudinal extension of the first output mouth;

wherein the second output mouth has respective second passage areas arranged in succession along the longitudinal extension of the second output mouth;

wherein the feeding assembly further comprises an operating device, which is designed to enable the output of the powder material of the first type and the powder material of the second type selectively through one or more of the first and the second passage areas;

wherein during the feeding step, the control unit operates the operating device so that the powder material of the first type and the powder material of the second type selectively passes through one or more of the first or the second passage areas.

2. The method according to claim 1, wherein the operating device comprises a plurality of operating units, each of which is arranged in the area of a respective first and/or second passage area and is designed to adjust the passage of the powder material of the first type and the powder material of the second type through the first and/or second passage area;

wherein the control unit controls each operating unit independently of the other operating units.

3. The method according to claim 1, wherein the control unit feeds the reference distribution along a virtual path through a virtual reference front depending on the data detected by the detection device;

wherein the virtual reference front has a plurality of positions, each of which corresponds to a first passage area and to a second passage area, which are adjacent to one another;

wherein the control unit operates the feeding assembly so as to enable the output of the powder material of the first type and the powder material of the second type at a specific time through the first and/or second passage areas depending on the powder material of the first type and the powder material of the second type indicated at the specific time, in the reference distribution, and in the positions of the virtual reference front corresponding to said passage areas.

4. The method according to claim 1, wherein the feeding assembly comprises a third containment chamber, which contains the powder material of the first type and the powder material of the second type received from the first and the second feeding device and transfers the powder material to the conveyor assembly in the area of the input station;

wherein the third containment chamber is arranged between the first and the second feeding device on one side and the conveyor assembly on the other side;

wherein a second detection device detects the level of powder material inside the third containment chamber;

wherein the control unit operates the feeding assembly depending on the level of powder material detected inside the third containment chamber.

5. The method according to claim 1 and further comprising a printing step, which takes place after the compacting step and during which a graphic decoration is created over the layer of compacted powder transported by the conveyor assembly in the area of a printing station along the given path downstream of the work station;

wherein the control unit controls the printing step so as to create the graphic decoration coordinated with said reference distribution.

6. The method according to claim 1, wherein the powder material of the first type is of a color that is different from the color of the powder material of the second type.

7. The method according to claim 6 and further comprising a printing step, which takes place after the compacting step and during which a graphic decoration is created over the layer of compacted powder transported by the conveyor assembly in the area of a printing station along the given path downstream of the work station;

wherein the control unit controls the printing step so as to create the graphic decoration coordinated with said reference distribution so that the graphic decoration with a particular color is reproduced in the area of the powder material of the first type.

* * * * *